United States Patent [19]

Blanchard

[11] 3,968,767

[45] July 13, 1976

[54] MARINE PROPULSION DEVICE ADAPTED FOR A SAILBOAT

[75] Inventor: Clarence E. Blanchard, Kenosha, Wis.

[73] Assignee: Outboard Marine Corporation, Waukegan, Ill.

[22] Filed: June 24, 1974

[21] Appl. No.: 482,468

[52] U.S. Cl. ..... 115/.5 E; 60/310

[51] Int. Cl.[2] ..... F01N 3/04

[58] Field of Search ..... 115/.5 E, .5 R, 17, 115/34 R, 12 R; 60/310

[56] References Cited

UNITED STATES PATENTS

| | | | |
|---|---|---|---|
| 3,181,495 | 5/1965 | Kiekhaefer | 115/34 R |
| 3,190,254 | 6/1965 | Meibauer | 115/.5 R |
| 3,194,205 | 7/1965 | Mattson et al. | 115/12 R |
| 3,485,040 | 12/1969 | Niskanen | 60/310 |
| 3,520,270 | 7/1970 | Miller | 115/17 |
| 3,541,786 | 11/1970 | Sarra | 60/310 |
| 3,765,479 | 10/1973 | Fish | 60/310 |
| 3,798,904 | 3/1974 | Gleason et al. | 60/310 |

*Primary Examiner*—Duane A. Reger
*Assistant Examiner*—Stuart M. Goldstein
*Attorney, Agent, or Firm*—Michael, Best & Friedrich

[57] ABSTRACT

Disclosed herein is a marine propulsion device comprising an engine including a bottom face with an exhaust gas passage port, together with a lower unit connected to the bottom face and including a side surface, and an exhaust gas passage communicating with the engine port and terminating in a port in the side surface, and an exhaust gas passage conduit connected to the lower unit in communication with the port in the side surface and extending upwardly therefrom to above the power head and thence downwardly. The engine includes a cooling jacket, and the lower unit has a substantially closed cavity including a gear box portion and a sleeve portion, together with a water jacket cavity surrounding the sleeve portion, and water inlet means communicating with the water jacket cavity. In addition, the lower unit includes a reversing transmission in the gear box portion of the substantially closed cavity and connecting a propeller shaft to a drive shaft extending in the sleeve portion of the substantially closed cavity, and a water pump supported within the lower unit and communicating with the engine cooling jacket and with the water jacket cavity for delivering water from the water jacket cavity to the engine cooling jacket.

14 Claims, 4 Drawing Figures

161
159
151
153
155
163
17
13
25
29
31
125
175
171
89
27
173
113
111
157
123
91
92
83
93
33
115
99
117
97
81
85
88
11
86
53
15
101
131
127
19
80
47
23
79
87
51
45
133
49
65
121
71
63
67
69
55
21
41
57
60
75
77
43
141
61
59

MARINE PROPULSION DEVICE ADAPTED FOR A SAILBOAT

Background of the Invention

The invention relates generally to marine propulsion devices and, more particularly, to marine propulsion devices adapted to be fixedly mounted in a boat hull, such as, for instance, in a sail boat hull.

Prior marine propulsion devices, such as outboard motors, have been modified to accommodate fixed mounting in sailboat hulls. Such modified outboard motors have included a conventional power head comprising an engine and other related components, which, in the non-modified outboard motor, was mounted to the top of a lower unit including a gear box and a drive shaft housing which was also connected to a mechanism for tiltably and swingably supporting the drive shaft housing (together with the powerhead and gear box) from a boat hull. Such prior modified outboard motors have also included the lower unit gear box to which a mounting flange was welded, and a structurally open bracket was substituted for the drive shaft housing and connected between the gear box and the engine. Such modified outboard motors also included an inverted U shaped exhaust pipe.

SUMMARY OF THE INVENTION

The invention provides a marine propulsion device including a power head or engine having a bottom face with an exhaust gas passage port, together with a lower unit connected to the bottom face and including a side surface, and an exhaust gas passage communicating with the power head and terminating in a port in the side surface of the lower unit. In addition, the marine propulsion device also includes an exhaust gas pipe connected to the lower unit in communication with the port in the side surface thereof, and extending upwardly therefrom to above the power head and then downwardly and adapted to be connected to a discharge duct adapted for discharging the exhaust gas into the atmosphere.

In one particular embodiment of the invention, the exhaust gas conduit is connected to the lower unit for pivotal movement relative thereto.

The invention also provides a marine propulsion device comprising an engine including a cooling jacket, together with a lower unit supporting the engine and including a substantially closed cavity including a gear box portion and a sleeve portion, and a water jacket cavity surrounding the sleeve portion. In addition, the marine propulsion device includes a propeller shaft mounted for rotation in the gear box portion of the substantially closed cavity and a reversing transmission located in the gear box portion of the substantially closed cavity and connecting the propeller shaft to a drive shaft extending in the sleeve portion of the substantially closed cavity. Still further in addition, the marine propulsion device includes water inlet means communicating with the water jacket cavity and a water pump supported within the lower unit and communicating with the engine cooling jacket and with the water jacket cavity.

In one particular embodiment of the invention, the lower unit comprises a lower casing including the substantially closed cavity and at least a part of the water jacket cavity, together with an intermediate casing connected between the lower casing and the power head or engine. Preferably, the intermediate casing includes a mounting flange extending generally transversely of the drive shaft and adapted for connection to the hull of a boat. The transition or intermediate casing also preferably encloses a part of the drive shaft, contains a water pump, and includes a downwardly open area forming a part of the water jacket cavity and extending in surrounding relation to the pump and to the drive shaft and in communication with the water jacket cavity part in the lower casing. Still further, it is preferred that the transition or intermediate casing include an exhaust gas passage which terminates, at one other end, in a first port adapted to communicate with an exhaust gas passage in the engine and which terminates, at the other end, in a second port located in a side surface of the transition casing.

One of the principal features of the invention is the provision of a marine propulsion device which is adapted to be fixedly mounted to a boat hull and which includes a side discharge exhaust port.

Another of the principal features of the invention is the provision of a marine propulsion device which is adapted to be fixedly mounted on a boat hull and which includes a side surface discharge exhaust port, together with an inverted U-shaped exhaust pipe pivotally mounted to the side surface in communication with the exhaust port.

Another of the principal features of the invention is the provision of a lower unit which is formed to be substantially full of water except for a substantially sealed or closed cavity containing a drive shaft, a propeller shaft, and a reversing transmission.

Another of the principal features of the invention is the provision of a lower unit including a water jacket cavity adapted for cooling a reversing transmission.

Still another of the features of the invention is the provision of a water jacketed and inverted U-shaped exhaust pipe connected to a lower unit side exhaust gas discharge port of a marine propulsion device.

Other features and advantages of the invention will become known by reference to the following drawings, general description, and claims.

Figure 1:
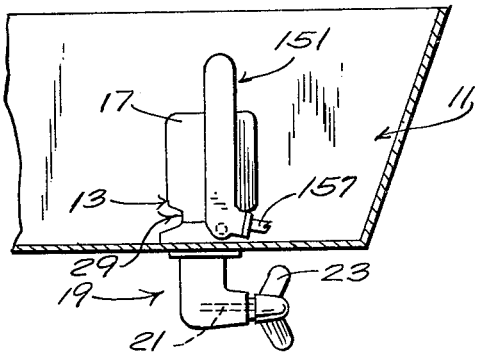
FIG. 1 is a fragmentary, side elevational view, partially in section, of a marine installation embodying various of the features of the invention.

Before explaining the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for the purposes of description and should not be regarded as limiting.

GENERAL DESCRIPTION

Figure 4:
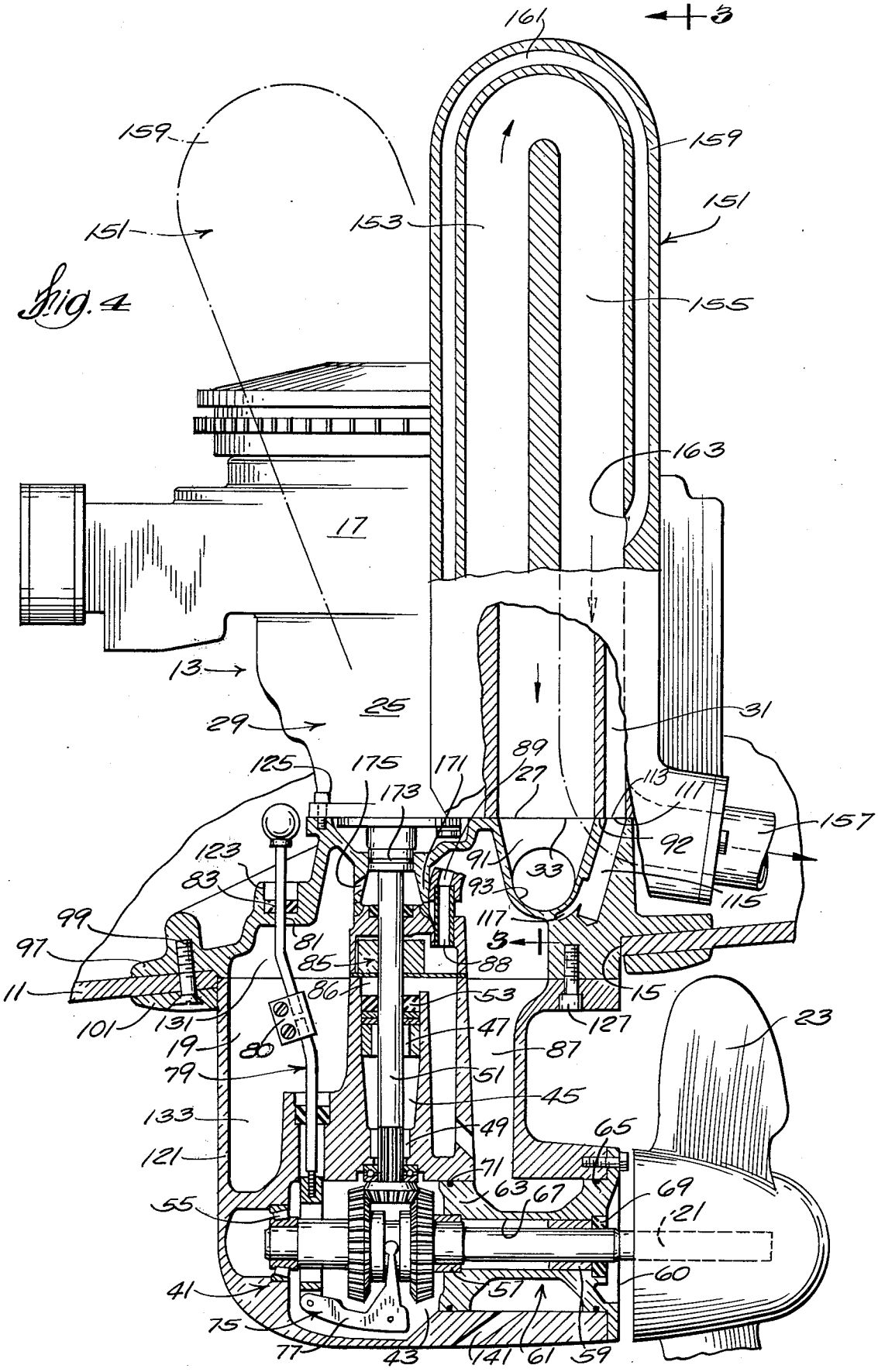
FIG. 4 is an enlarged view, partially broken away and in section of the marine propulsion device shown in FIG. 1.

Fragmentarily illustrated in FIG. 1 and also shown in FIG. 4 is a boat hull 11, such as a sailboat hull, and a marine propulsion device 13 which is fixedly mounted to the boat hull 11. As illustrated best in FIG. 4, the boat hull 11 includes, on the under surface thereof, an opening 15 through which extends the marine propulsion device 13. More specifically, the marine propulsion device 13 includes a power head 17 mounted on the top of a lower unit 19 which extends through the opening 15 and which rotatably supports a propeller shaft 21 carrying a propeller 23.

Still more specifically, the power head 17 includes an engine block 25 having a bottom or mounting surface 27, together with such related equipment as a carburator, air filter, fuel pump, etc., (not specifically shown) to provide an operating internal combustion engine 29 including a cooling jacket 31 and an exhaust gas discharge port 33 in the bottom surface 27 of the power head 17.

The lower unit 19 includes wall means for defining a substantial closed or sealed cavity 41 including a gear case portion 43 and a sleeve portion 45 extending upwardly from and communicating with the gear case portion 43.

Rotatably carried in the sleeve portion 45 by upper and lower bearings 47 and 49 is a drive shaft 51 which extends through the lower unit 19 and which is suitably connected to and driven by the engine 29. Situated above the upper bearing 47 and between the drive shaft 51 and the sleeve portion 45 is a seal 53 which prevents entry of water into the substantially closed cavity 41.

The propeller shaft is suitably mounted in the gear case portion 43 by bearings 55, 57, and 59 and projects outwardly through the rear face 60 of the lower unit 19. The bearings 57 and 59 are carried by a spool 61 which includes a forward flange 63 and a rearward flange 65 which forms the rear face 60, together with a central core 67 communicating with and forming a part of the gear case portion 43 of the substantially sealed cavity 41. The spool 61 is received in a cylindrical opening extending into the lower unit 19 from the rear thereof. A seal 69 is provided rearwardly of the bearing 59 between the propeller shaft 21 and the bore 67 of the spool 61 and a seal 71 is provided between the forward flange 63 of the spool 61 and the lower unit 19 to prevent entry of water into the substantially sealed cavity 41.

Also included in the cavity 41 is a reversing mechanism 75 which is adapted to selectively connect the drive shaft 51 to the propeller shaft 21 in forward drive, reverse drive, and neutral conditions. Included in the reversing transmission 75 is an operating lever 77 which is pivotally mounted in the cavity 41 and pivotally connected to a vertically movable operating linkage 79 extending through an opening 81 in the upper part of the lower unit for connection to an operating mechanism (not shown) in the boat hull 11. Located between the linkage 79 and the opening 81 in the upper portion of the lower unit is a seal 83 to prevent entry of water into the boat hull 11 from the water within the lower unit 19 as will be hereinafter disclosed.

The linkage 79 includes a separable connection 80 which, when broken, permits removal of the lower portion of the lower unit 19 from the upper portion as will also hereinafter be disclosed. As the reversing transmission 75 otherwise generally of conventional construction, no further description is believed to be necessary.

Suitably supported by the wall means defining the top part of the sleeve portion 45 is a water pump 85 which is driven by the drive shaft 51 and which includes an inlet 86 communicating with a water jacket cavity 87 (still to be described) and an outlet 88 communicating with a duct 89 leading to the cooling jacket 31 of the power head 17.

Also included in the lower unit 19 is wall means forming the water jacket cavity 87 which extends above and behind the gear case portion 43 of the substantially sealed cavity 41 and completely around the sleeve portion 45 of the substantially closed cavity 41, as well as around the water pump 85 and the drive shaft 51.

Figure 3:
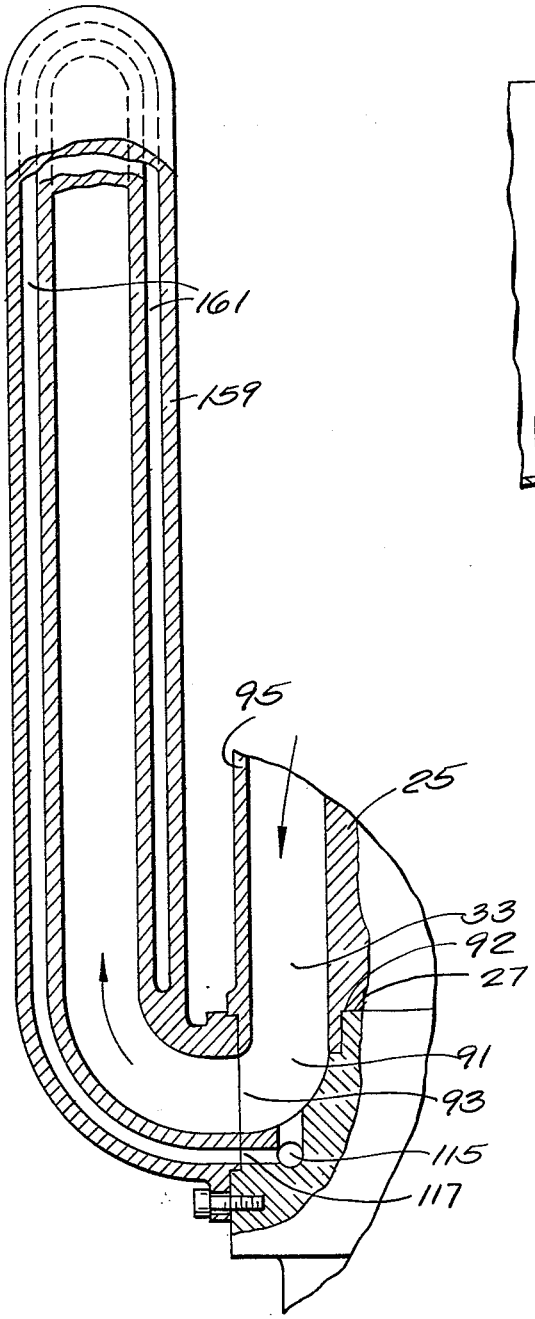
FIG. 3 is an enlarged fragmentary view, partially broken away in section, taken along line 3—3 of FIG. 4.

Also included in the lower unit 19 is an exhaust passage 91 which terminates, at one end, at the upper face 92 of the lower unit 19 in position to communicate with the power head exhaust port 33 and which terminates, at its other end, in a port 93 in a side surface of the lower unit. (See FIG. 3)

The lower unit 19 further includes a mounting flange 97 which is preferably annular and which extends generally transversely of the drive shaft 51, and which is adapted for mounting of the marine propulsion device 13 to the boat hull 11. More specifically, the flange 97 can be fixed to the boat hull 11 by a series of bolts 99 which extend through the hull 11 from a ring or washer 101. Other suitable arrangements can also be employed.

In addition to the foregoing, the upper face 92 of the lower unit 19 includes a port 111 which is located for communication with a drain or discharge port 113 from the cooling jacket 31 in the power head 17. The port 111 communicates with a duct 115 which, in turn, terminates in an arcuately extending port 117 located adjacent to the exhaust gas discharge port 93 in the side surface 92 of the lower unit 19.

In the specifically illustrated construction, the lower unit 19 includes a lower casing 121 and an intermediate or transition casing 123. The intermediate casing 123 is fixed intermediate of and to the power head 17 and the lower casing 121 by bolts 125 and 127, respectively. As illustrated, the sealed cavity 41 is formed in the lower casing 121 and the duct 115 and exhaust passage 91 are formed in the intermediate or transition casing 123. The water jacket cavity 87 extends into upper and lower areas 131 and 133 located respectively within the transition or intermediate casing 123 and the lower casing 121.

In the illustrated construction, the mounting flange 97 extends from the intermediate casing 123 to permit removal of the lower casing 121 from the intermediate casing 123 without affecting the water-tight integrity of the boat hull 11. However, the flange could extend from the lower casing 121.

Also included in the lower unit 19 are water inlet means in the form of one or more ducts which extend through the outer wall of the lower unit 19 and communicate with the water jacket cavity 87 in the area below the spool 61 and between the forward and rearward flanges 63 and 65. Of course, other inlet means in other areas could also be employed to supply water to the water jacket cavity 87.

In further accordance with the invention, there is provided an exhaust pipe 151 which is connected to the side surface 92 of the lower unit 19 in communication with the exhaust port 93. The exhaust pipe 151 is of inverted, U-shape and includes one leg 153 extending upwardly above the power head 17 sufficiently to prevent entry of water through the exhaust pipe 151 into the engine 29. The exhaust pipe 151 also includes a second leg 155 which extends downwardly from the top to the first leg 153 and, at its lower end, is adapted to be connected to a discharge pipe 157 which can include a muffler (not shown) and which discharges exhaust gas into the atmosphere, i.e., into either the air or into the water.

Figure 2:
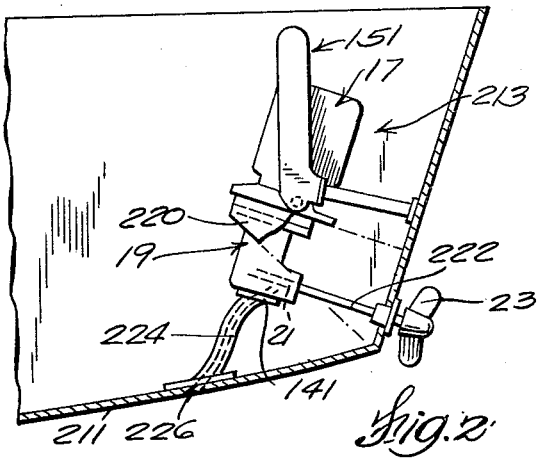
FIG. 2 is a view similar to FIG. 1 showing another embodiment of a marine installation in accordance with the invention.

Preferably, the exhaust pipe 151 is connected to the lower unit 19 to afford pivotal movement of the exhaust pipe 151 relative to the lower unit 19 in order to accommodate positioning of the pipe 151 in a generally vertical disposition regardless of whether the marine propulsion device 13 is mounted as shown in FIG. 1 or in FIG. 2.

In addition, the exhaust pipe 151 is preferably water jacketed and, in this regard, includes an outer sleeve 159 which forms a water jacket 161 around the exhaust pipe 151 and which communicates with the cooling water discharge port 117 in the side surface 92 of the lower unit 19. The exhaust pipe water jacket 161 preferably extends for the full length of the first leg 153 of the exhaust pipe 151 and at least for a portion of the length of the second leg 155 and empties into the second leg through a port 163 below the top of the second leg 155 for drainage of the cooling water through the discharge pipe 157 into the atmosphere with the exhaust gas.

The upper part of the intermediate casing 123 includes a downwardly extending sleeve portion 171 which engages the top of the water pump 85 and through which extends the drive shaft 51. A seal 173 is provided between the drive shaft 51 and the sleeve portion 171 to prevent entry of water above the seal 173. In addition, a release port 175 is provided in the sleeve portion 171 to prevent excessive pressures from building up within the sleeve portion 171 below the seal 173.

Shown in FIG. 2 is another embodiment of a boat hull 211 mounting a marine propulsion device 213 which is constructed in accordance with the invention and which is substantially similar to the device 13 and accordingly, the device 213 will not again be described, except as set forth below. In the environment shown in FIG. 2, the marine propulsion device 213, except for the propeller 23, is wholly mounted within the boat hull 211, on a support or bracket 220 fixed on the hull. In addition, the propeller shaft 21 is coupled to an extension 222 which is suitably rotatably supported and which passes through the boat hull and supports the propeller 23 rearwardly of at least a portion of the boat hull 213. In addition, the cooling water inlet port 141 in the lower unit 19 is connected through a conduit 224 with a suitable water inlet port 226 in the boat hull 211. It is noted that in the construction shown in FIG. 2, the marine propulsion device 213 is mounted at an angle to the horizontal so as to align the propeller shaft 21 with the remotely located propeller 23 and that the exhaust pipe 151 is angularly displaced from the position shown in FIG. 1 so as to extend generally vertically.

Operation of the engine causes the water pump 85 to substantially fill the lower unit with water (except for the cavity 41), which water is eventually discharged to the atmosphere with the exhaust gas, other than directly from the lower unit into the water. Filling of the lower unit 19 with water, except for the cavity 41, serves to effect cooling of the reversing transmission 75, particularly when the marine propulsion device is mounted as shown in FIG. 2. One of the advantages of the construction resides in the ability to utilize standard outboard motor lower unit and power head components with little if any modification.

Various of the features of the invention are set forth in the following claims:

What is claimed is:

1. A marine propulsion device comprising a power head including a bottom face having therein an exhaust gas passage port, a lower unit connected to said bottom face and including a side surface which is intended to extend generally vertically when the marine propulsion device is boat mounted, a propeller shaft, a propeller carried on said propeller shaft, and an exhaust gas passage communicating with said power head port and terminating in a port in said side surface, and an exhaust gas passage conduit connected to said side surface in communication with said port and extending upwardly therefrom to above said power head and downwardly therefrom and being adapted to be connected to a duct discharging the exhaust gas into the atmosphere, whereby variation in the angular relationship of said conduit to said power head in a generally vertical plane is permitted by the connection of said conduit to said side surface.

2. A marine propulsion device comprising a power head including a bottom face having therein an exhaust gas passage port, a lower unit connected to said bottom face and including a side surface, a propeller shaft, a propeller carried on said propeller shaft, and an exhaust gas passage communicating with said power head port and terminating in a port in said side surface, and an exhaust gas passage conduit connected to said lower unit for pivotal movement relative thereto and in communication with said port in said side surface and extending upwardly therefrom to above said power head and downwardly therefrom and being adapted to be connected to a duct discharging the exhaust gas into the atmosphere.

3. A marine propulsion device in accordance with claim 1 wherein said lower unit includes a flange adapted to be mounted to the hull of a boat.

4. A marine propulsion device comprising an engine including a cooling jacket, a lower unit supporting said engine and including a substantially closed cavity including a gear box portion and a sleeve portion and a water jacket cavity surrounding said sleeve portion, water inlet means communicating with said water jacket cavity, a propeller shaft mounted for rotation in said gear box portion of said substantially closed cavity, a propeller carried by said propeller shaft, a drive shaft connected to said engine and extending into said sleeve portion of said substantially closed cavity, gear means in said gear box portion of said substantially closed cavity and connecting said drive shaft to said propeller shaft, and a water pump supported within said lower unit and communicating with said cooling jacket and with said water jacket cavity for delivering water from said water jacket cavity to said cooling jacket.

5. A marine propulsion device in accordance with claim 4 wherein said lower unit includes a mounting flange extending generally transversely of said drive shaft and adapted for connection to the hull of a boat.

6. A marine propulsion device in accordance with claim 4 wherein said lower unit includes a side discharge exhaust port and an exhaust conduit is connected to said lower unit in communication with said side discharge exhaust port and extends in inverted U-shape.

7. A marine propulsion device in accordance with claim 4 wherein said lower unit includes a lower casing including said substantially closed cavity and an upwardly open area which extends in surrounding relation to said sleeve portion of said substantially closed cavity and which forms a part of said water jacket cavity, and an intermediate casing which is connected to said engine and to said lower casing, which, in part, houses said drive shaft, which contains said water pump and which includes a downwardly open area forming a part of said water jacket cavity and extending in surrounding relation to said pump and to said drive shaft and in communication with said area in said lower casing.

8. A marine propulsion device in accordance with claim 7 wherein said intermediate casing includes an exhaust gas passage which terminates, at one end, in a first port adapted to communicate with an exhaust gas passage in said engine and which terminates, at the other end, in a second port located in a side surface of said intermediate casing.

9. A marine propulsion device in accordance with claim 5 wherein said lower unit includes a lower casing and an intermediate casing connected to said engine and to said lower casing and wherein said intermediate casing includes said flange.

10. A marine propulsion device in accordance with claim 5 wherein said lower unit includes a lower casing and an intermediate casing connected to said engine and to said lower casing and wherein said lower casing includes said flange.

11. A marine propulsion device comprising a power head including a bottom face having therein an exhaust gas passage port, a lower unit connected to said bottom face and including a side surface which is intended to extend generally vertically when the marine propulsion device is boat mounted, a propeller shaft, a propeller carried on said propeller shaft, and an exhaust gas passage communicating with said power head port and terminating in a port in said side surface, and an exhaust gas passage conduit connected to said side surface in communication with said port and adapted to be connected to a duct discharging the exhaust gas into the atmosphere, whereby variation in the angular relationship of said conduit to said power head in a generally vertical plane is permitted by the connection of said conduit to said side surface.

12. A marine propulsion device in accordance with claim 11 wherein said exhaust gas conduit is connected to said lower unit for pivotal movement relative thereto.

13. A marine propulsion device in accordance with claim 11 wherein said lower unit includes a flange adapted to be mounted to the hull of a boat.

14. A marine propulsion device in accordance with claim 2 wherein said lower unit includes a flange adapted to be mounted to the hull of a boat.

* * * * *